United States Patent [19]

Del Sarto

[11] 4,102,505

[45] Jul. 25, 1978

[54] PULP REFINING DISK

[75] Inventor: Franco Del Sarto, Sao Paulo, Brazil

[73] Assignee: Inox Industria E. Comercio de Aco S/A, Sao Paulo, Brazil

[21] Appl. No.: 778,050

[22] Filed: Mar. 16, 1977

[30] Foreign Application Priority Data

Dec. 8, 1976 [BR] Brazil ..... 08232
Dec. 8, 1976 [BR] Brazil ..... 08233

[51] Int. Cl.[2] ..... B02C 7/12
[52] U.S. Cl. ..... 241/297; 241/298
[58] Field of Search ..... 241/261.2, 261.3, 296, 241/297, 298, 300

[56] References Cited

U.S. PATENT DOCUMENTS

| | | | |
|---|---|---|---|
| 2,970,783 | 2/1961 | Cheyette | 241/300 |
| 3,128,055 | 4/1964 | Michel | 241/298 |
| 3,193,206 | 7/1965 | Bidwell | 241/298 X |
| 3,326,480 | 6/1967 | Jones | 241/298 |

*Primary Examiner*—Roy Lake
*Assistant Examiner*—Howard N. Goldberg
*Attorney, Agent, or Firm*—Cesari and McKenna

[57] ABSTRACT

An improved pulp refining disk comprises an annular plate having openings formed in it. Arrays of closely spaced parallel upstanding fins which function as refining surfaces are secured to the plate in the openings so that the grooves between the fins are unobstructed following which the openings are filled with resin. Upstanding pins are positioned in the grooves at the periphery of the disk to constrict the pulp fibers. A set of tabs project radially inward from the plate contain bolt passages for securing the disk to the refiner. Provision is made for securing a second similar disk to the opposite face of the plate, the securement being by means of bolts extending through holes in the first plate and turned down into threaded holes in the second plate. Alternatively, the two plates can be bevelled at their adjacent peripheral edges to form a groove and joined by solder or brazing in the groove.

7 Claims, 4 Drawing Figures

PULP REFINING DISK

BACKGROUND OF THE INVENTION

This invention relates to paper pulp refining apparatus. It relates more particularly to an improved rotary pulp refining disk used in reducing fibers to make paper pulp and the like.

Pulp refining disks are used in the paper industry among others to reduce pulp fibers. Basically they comprise a base for supporting arrays of closely spaced upstanding fins or winglets. The winglets are secured to the base by welding or brazing or the like. The disk is attached to the shaft of a refiner and when rotated, the disk winglets reduce the fibers.

Heretofore pulp refining disks have been relatively heavy so that they have considerable inertia. Also the mode of securing the winglets to the base has resulted in weld or solder points in the grooves between the winglets which interfered with the pulp refining process. Also, some prior disks have had a relatively short life because they are corroded by the pulp and the winglets become worn. Therefore refiners have been characterized by a considerable amount of down time while the disks are being repaired or replaced.

SUMMARY OF THE INVENTION

Accordingly the present invention aims to provide an improved rotary pulp refining disk that has a relatively long useful life.

Another object is to provide a disk of this type which is relatively lightweight so that it requires less driving torque.

Still another object is to provide a pulp refining disk whose winglets are anchored to the base in such a way that the grooves between the winglets are free of obstructions.

Still another object is to provide a bipartite disk of this type, both sides of which are used to refine pulp.

Other objects will, in part, be obvious and will, in part, appear hereinafter.

The invention accordingly comprises the features of construction, combination of elements and arrangement of parts as exemplified in the following detailed description, and the scope of the invention will be indicated in the claims.

Briefly, my improved disk comprises an annular base plate made of a non-corrosive material such as stainless steel. The plate is formed with an array of axial openings or passages distributed around its periphery in order to minimize the weight of the plate so that less torque is required to rotate the disk. The usual radial arrays of closely spaced, parallel upstanding winglets or fins which function as refining surfaces are anchored to the plate. However, the points of securement are at the ends of the winglets and in the passages so that the grooves between the winglets are free of weld beads, soldering spots and other obstructions thereby optimizing the performance of the disk.

After the winglets are secured to the plate, the openings are filled with a hard, but lightweight material such as resin. The use of the resin filler plugs not only reduces the weight of the disk. It also reduces its cost because less of the expensive stainless steel material is required. Yet the strength of the disk is not jeopardized. A circular array of pins project up from the plate in the grooves at the periphery of the disk to help constrict the pulp fibers as the disk rotates. Also the plate has a set of radially, inwardly extending tabs with passages for accommodating bolts by which the disk is secured to the refiner.

Secured to the opposite face of the disk of the plate is a second similar disk having a base plate, winglets and fins. This second disk is secured to the plate of the basic disk in a fashion that does not interfere with the disk refining function. In one embodiment, the two disks are secured together by a circular array of bolts extending through the basic disk and turned down into openings in the supplementary disk. Alternatively, the peripheries of the two disk plates are bevelled at their opposing peripheral edges and solder wire made of the same material as the plates is soldered into the groove formed by the two bevels.

Thus when the winglets on the basic disk become excessively worn or the disk becomes damaged for other reasons, it can simply be removed from the refiner and reversed so that the supplementary disk takes over. This reduces the down time of the refiner. In the event that it becomes necessary to separate the disks to replace one of them, the bolts can be removed or the solder wire worn or melted away to release the connection between the two disk plates.

BRIEF DESCRIPTION OF THE DRAWINGS

For a fuller understanding of the nature and objects of the invention, reference should be had to the following detailed description taken in connection with the accompanying drawings in which.

DESCRIPTION OF THE PREFERRED EMBODIMENTS

Figure 1:
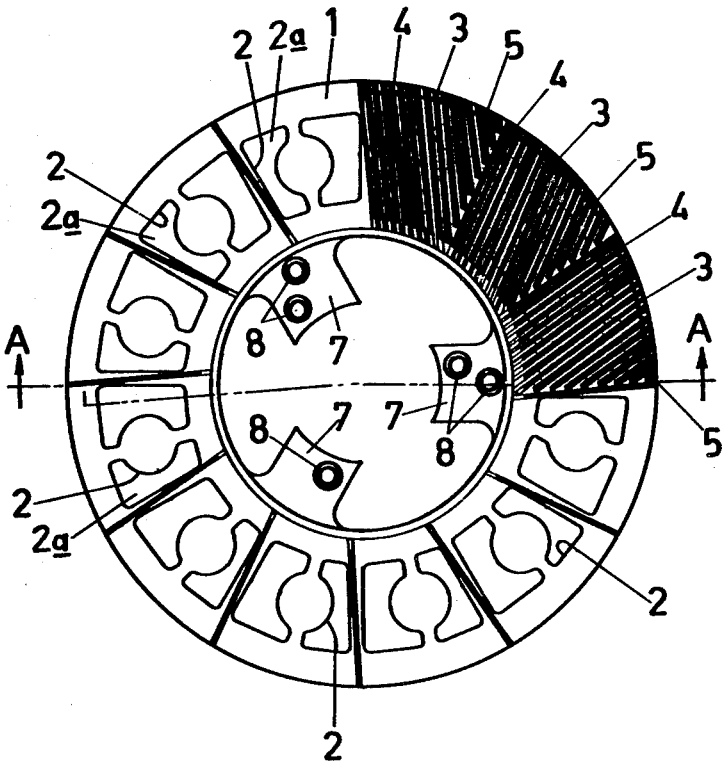
FIG. 1 is a planar view of the working side of a disk made in accordance with my invention.
Figure 2:
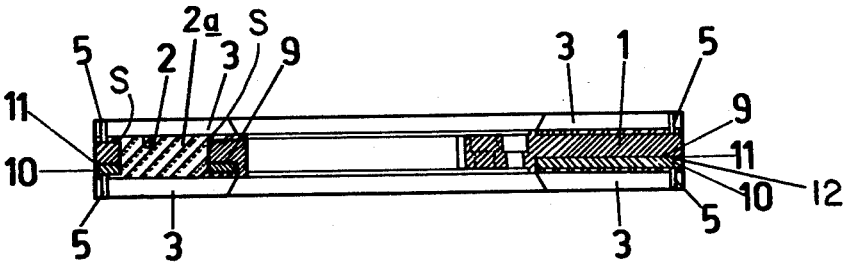
FIG. 2 is a sectional view along line A—A of FIG. 1.

Referring to FIGS. 1 and 2, the basic disk comprises a flat annular plate 1 made of a corrosive-resistant material such as #304 stainless steel. The plate is machined with a circular array of axial hollows or passages 2 in order to reduce the required amount of stainless steel which is a relatively expensive material and also in order to minimize the weight of the disk. Positioned over the passages 2 in spaced-parallel relation in radial arrays are sets of upstanding fins or winglets 3 which function as refining surfaces. The winglets are fastened to the plate at their ends and at points in their bottoms at the edges of the passages 2 by spot welds S so that the grooves 4 between the winglets 3 are unobstructed by soldering points, weld spots and the like. Following this, the passages 2 are filled with plugs **2*a* of a suitable lightweight resin material such as that sold under the brand name Silinox which also serves to conceal the spot welds in passages 2**.

A circular array of pins 5 project up from plate 1 in the grooves 4 near the periphery of the disk. These help to constrict the pulp fibers when the disk rotates.

Projecting radially inward from the inner edge of plate 1 are a set of three tabs 7. These tabs contain axial passages 8 for accommodating bolts by which the disk is fastened to the refiner.

The opposite side or face of plate 1 is formed with an annular recess 9. Positioned in recess 9 is a second similar disk composed of an annular plate 10 which is sized to be received snugly in recess 9. Projecting out from plate 10 are winglets 3 and pins 5 arranged in the same way as those corresponding components on the basic disk.

As best seen in FIG. 1, in this disk embodiment the two disks are secured together at the peripheries of the adjacent base plate faces. More particularly, bevels are formed at the opposing peripheral edges of the plates thus creating a wedge-shaped peripheral groove 12 for retaining a soldering wire 11 which is melted to anchor the two plates together.

When it is necessary to uncouple the two disks, this can be accomplished easily by abrading or wearing away the soldering wire 11 or remelting it.

Figure 3:
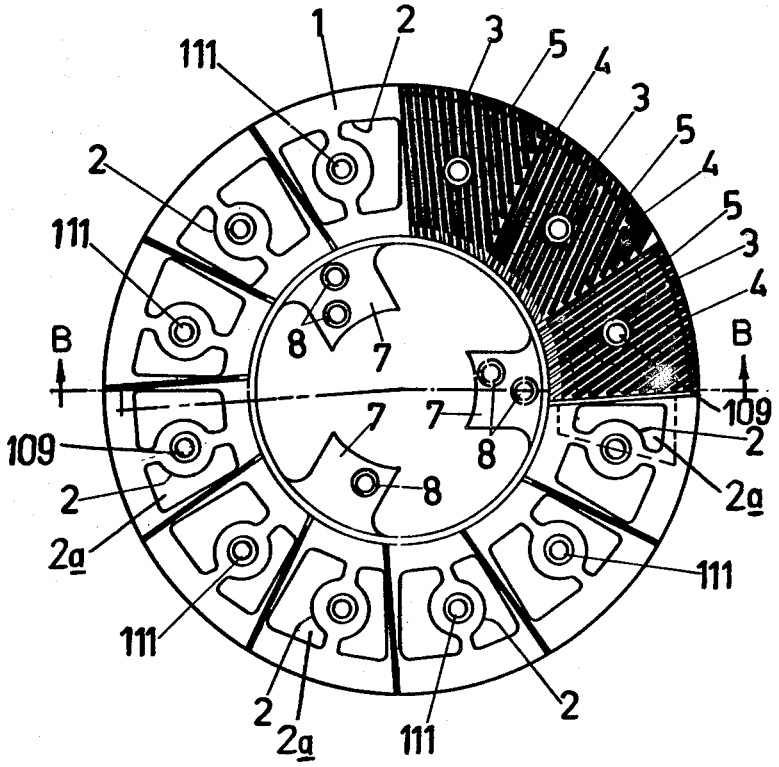
FIG. 3 is a view similar to FIG. 1 of another disk embodiment.
Figure 4:
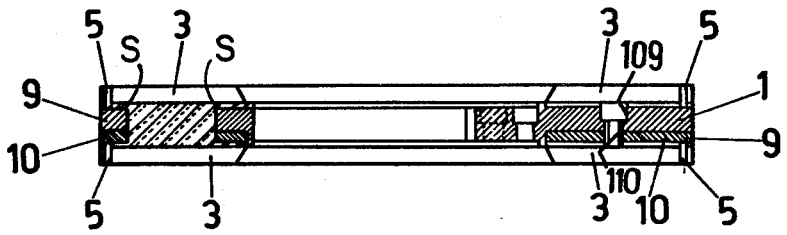
FIG. 4 is a view along line B—B of FIG. 3.

FIGS. 3 and 4 show a second disk embodiment which is more or less the same as the first embodiment except for the means utilized to connect the two disks together. Elements in the FIGS. 3 and 4 embodiment carry the same identifying numerals as the corresponding elements in FIGS. 1 and 2.

Instead of connecting the two disks together by means of a soldering wire, the FIGS. 3 and 4 disk embodiment is provided with a circular array of passages 109 in plate 1 disposed between passages 2. Additionally, threaded passages 110 are provided at corresponding locations in the other plate 10. Then the two plates are secured together by bolts 111 extending down through passages 109 and turned down to passages 110. The winglets 3 are cut away as needed to permit bolts 111 to be inserted into plate 1. In the event that one or the other disk becomes damaged, it can be removed and replaced simply by removing the bolts.

It will thus be seen that the objects set forth above among those made apparent from the preceding description are efficiently attained, and since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

I claim:

1. An improved pulp refining disk comprising a circular rigid plate, means defining axial passages in the plate, an array of spaced-apart winglets projecting up from one face of the plate so as to define an array of grooves between the winglets, each said winglet having opposite ends and a bottom edge, each said winglet extending over a said passage, means for anchoring the edge of each winglet to the plate at a location in a said passage, a settable lightweight plug filling each said passage and means integral with the plate for securing the disk to a refiner.

2. The disk defined in claim 1 and further including an array of pins projecting up from the plate in the grooves between the winglets at the periphery of the plate, and means for securing the pins to the plate.

3. The disk defined in claim 1 wherein the plate is made of stainless steel and the settable material is resin.

4. The disk defined in claim 1 and further including means connecting the winglets to the plate at the ends of the winglets.

5. The disk defined in claim 1 and further including means defining a recess in a side of said plate opposite the winglets and further including a second similar disk comprising a second plate received in the recess of the first plate, a second array of winglets projecting from the side of the second plate opposite the first plate, second means for anchoring the second array winglets to the second plate, and means for connecting the second plate to the first plate.

6. The disk defined in claim 5 wherein the connecting means comprises corresponding arrays of registering passages in the first and second plates, one of said passages in one of said arrays being threaded, and a set of bolts extending through the passages and mating with the threaded passages.

7. The disk defined in claim 5 wherein the connecting means comprises means defining bevels at the opposing peripheral edges of the first and second plate to form a circumferential groove, and a settable adherent material filling the groove.

* * * * *